US007986232B2

(12) United States Patent
Sharma

(10) Patent No.: US 7,986,232 B2
(45) Date of Patent: Jul. 26, 2011

(54) METHOD AND APPARATUS FOR USING AN INFRARED REFLECTIVITY SENSOR IN A SECURITY SYSTEM

(75) Inventor: Raman Kumar Sharma, Toronto (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 160 days.

(21) Appl. No.: 11/498,930

(22) Filed: Aug. 3, 2006

(65) Prior Publication Data

US 2008/0030328 A1 Feb. 7, 2008

(51) Int. Cl.
*G08B 13/08* (2006.01)
*G08B 13/18* (2006.01)

(52) U.S. Cl. ..... 340/545.1; 340/545.3; 340/552

(58) Field of Classification Search ..... 340/545.1, 340/552

See application file for complete search history.

(56) References Cited

U.S. PATENT DOCUMENTS

| | | | | |
|---|---|---|---|---|
| 4,092,636 | A * | 5/1978 | Shepherd | 340/545.3 |
| 4,507,654 | A * | 3/1985 | Stolarczyk et al. | 340/545.3 |
| 4,688,244 | A | 8/1987 | Hannon et al. | |
| 4,812,810 | A * | 3/1989 | Query et al. | 340/545.3 |
| 4,949,074 | A | 8/1990 | D'Ambrosia et al. | |
| 4,999,607 | A | 3/1991 | Evans | |
| 5,164,707 | A * | 11/1992 | Rasmussen et al. | 340/551 |
| 5,499,016 | A * | 3/1996 | Pantus | 340/555 |
| 5,608,207 | A * | 3/1997 | Allen et al. | 250/214 AG |
| 5,903,217 | A * | 5/1999 | Stanczak et al. | 340/554 |
| 5,910,767 | A | 6/1999 | Frucht | |
| 5,912,619 | A * | 6/1999 | Vogt | 340/545.1 |
| 5,936,224 | A * | 8/1999 | Shimizu et al. | 235/462.1 |
| 6,044,256 | A * | 3/2000 | Kobayashi | 455/404.1 |
| 6,218,955 | B1 * | 4/2001 | Conklin | 340/5.61 |
| 6,259,352 | B1 * | 7/2001 | Yulkowski et al. | 340/5.7 |
| 6,411,215 | B1 | 6/2002 | Shnier | |
| 6,624,750 | B1 * | 9/2003 | Marman et al. | 340/506 |
| 6,642,846 | B1 * | 11/2003 | Krubiner et al. | 340/545.3 |
| 6,791,461 | B2 * | 9/2004 | Oku et al. | 340/573.1 |
| 7,394,451 | B1 * | 7/2008 | Patten et al. | 361/679.41 |
| 2004/0130437 | A1 * | 7/2004 | Stevens | 340/5.72 |
| 2005/0195101 | A1 * | 9/2005 | Stevens et al. | 342/28 |
| 2007/0130833 | A1 * | 6/2007 | Maital | 49/31 |

FOREIGN PATENT DOCUMENTS

EP 0 556 898 A1 8/1993

OTHER PUBLICATIONS

Application No. 07763847.6-1232/2047441; "Summons to Attend Oral Proceedings"; Dated Mar. 2, 2010; 5 pages.

* cited by examiner

*Primary Examiner* — George A Bugg
*Assistant Examiner* — Jack Wang
(74) *Attorney, Agent, or Firm* — The Small Patent Law Group LLP

(57) ABSTRACT

The IR sensor is configured to be mounted proximate to a door to be monitored. The IR sensor has an IR transmitter and an IR receiver. The IR transmitter has an active period and an idle period. The IR transmitter transmits control data packets which are provided by the processor during the active period. The IR receiver has an active period for detecting IR data and reflected data packets. Each of the reflected data packets has a packet IR reflectivity. The memory stores a door IR reflectivity associated with a door surface of the door, and the processor compares the packet IR reflectivity to the door IR reflectivity to determine at least a door position of the door.

23 Claims, 6 Drawing Sheets

METHOD AND APPARATUS FOR USING AN INFRARED REFLECTIVITY SENSOR IN A SECURITY SYSTEM

BACKGROUND OF THE INVENTION

This invention relates generally to security systems, and more particularly, to door proximity sensors used in security systems.

Security systems are typically used to monitor and control entry and exit points within a building, as well as perform other functions such as fire and smoke detection. A sensor is typically installed proximate to each door that is to be monitored. Several types of sensors may be used to detect whether the door is open or closed by detecting the proximity of the door.

For example, a mechanical contact, a reed switch/magnet combination, or an infrared (IR) sensor may be installed. Unfortunately, each of these sensors may be defeated by a person having limited knowledge of the sensor and/or security system. Mechanical contacts can be easily defeated by using a strip of metal or other material to depress the contact and keep it actuated while the door is compromised. Also, reed switch/magnet combinations may be defeated from the outside by using an additional magnet to keep the reed switch actuated. IR sensors have been used which constantly transmit IR, then compare the received or reflected IR to the transmitted IR. The IR sensors may be defeated by shining a light, such as a flashlight, at the IR sensor. Sunlight may also cause interference.

Therefore, a need exists for a door and/or proximity sensor which eliminates intentional or inadvertent interference. Certain embodiments of the present invention are intended to meet these needs and other objectives that will become apparent from the description and drawings set forth below.

BRIEF DESCRIPTION OF THE INVENTION

In one embodiment, a security system comprises an infrared (IR) sensor, a processor and a memory. The IR sensor is configured to be mounted proximate to a door to be monitored. The IR sensor has an IR transmitter and an IR receiver. The IR transmitter has an active period and an idle period. The IR transmitter transmits control data packets which are provided by the processor during the active period. The IR receiver has an active period for detecting IR data and reflected data packets. Each of the reflected data packets has a packet IR reflectivity. The memory stores a door IR reflectivity associated with a door surface of the door, and the processor compares the packet IR reflectivity to the door IR reflectivity to determine at least a door position of the door.

In another embodiment, a method for using an IR sensor to detect a door position in a security system comprises transmitting a control data packet with an IR transmitter of an IR sensor to detect a surface associated with a door. A reflected data packet is received with an IR receiver of the IR sensor. The reflected data packet has a packet IR reflectivity. The packet IR reflectivity is compared to the door IR reflectivity which is based on the surface associated with the door, and a status of the door is determined based on the comparison.

In another embodiment, a security system comprises a security control panel and an IR sensor located remote from the security control panel. The IR sensor is connected to the security control panel by a network. The IR sensor is mounted proximate to a door to be monitored and has an IR transmitter and an IR receiver. The IR transmitter has an active period and an idle period. The IR transmitter transmits control data packets provided by a processor during the active period. The IR receiver detects reflected data packets and IR data. The reflected data packets reflect off a surface and have a packet IR reflectivity. The processor compares a door IR reflectivity associated with the a door surface to the packet IR reflectivity to determine a door position of the door. Means is provided for transmitting a status signal from the IR sensor to the security control panel based on the comparison of the door IR reflectivity and the packet IR reflectivity.

Figure 1:
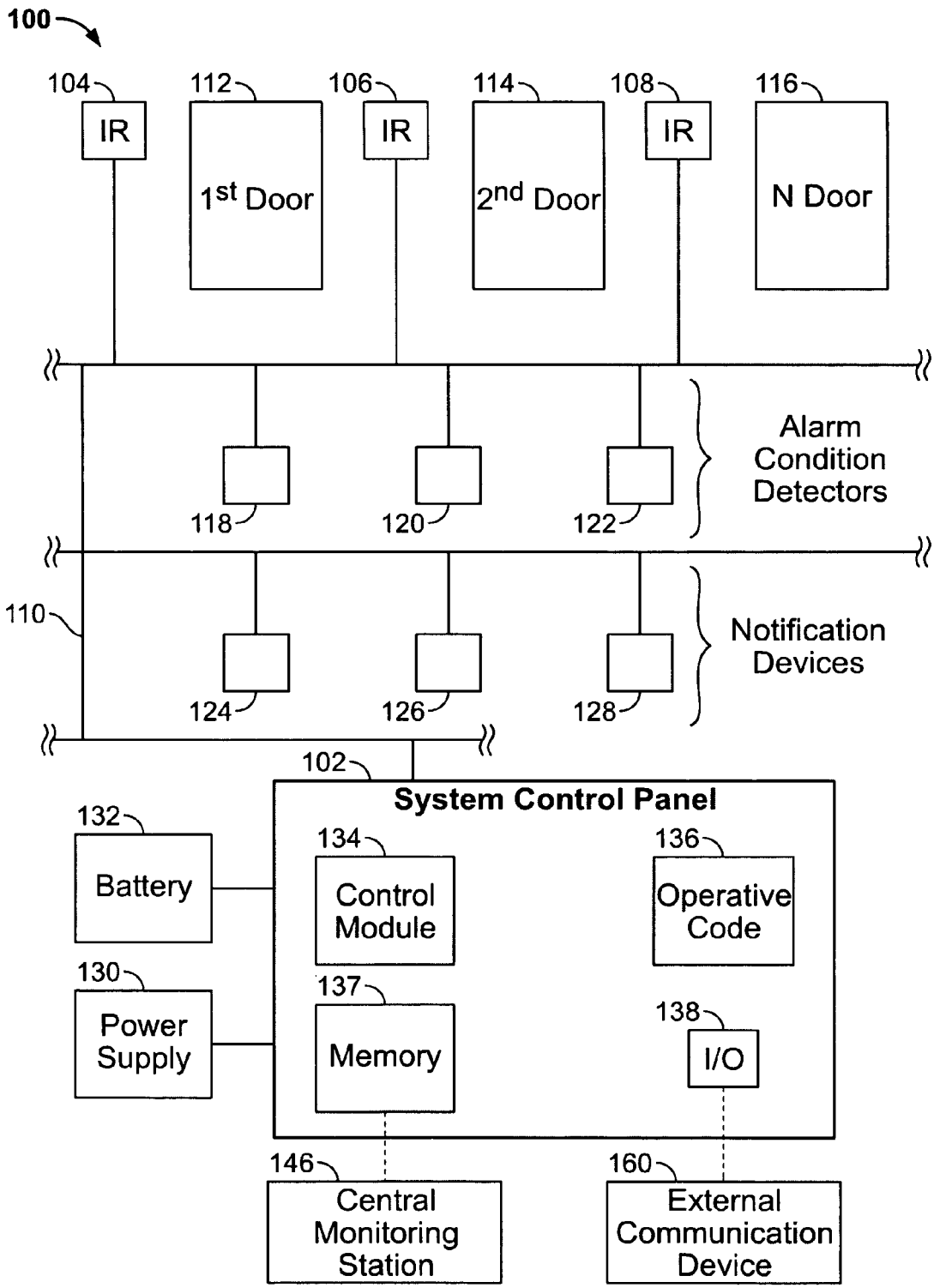
FIG. 1 illustrates a security system which has a system control panel for monitoring and/or controlling devices installed on a network formed in accordance with an embodiment of the present invention.

The foregoing summary, as well as the following detailed description of certain embodiments of the present invention, will be better understood when read in conjunction with the appended drawings. To the extent, that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block or random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

DETAILED DESCRIPTION OF THE INVENTION

FIG. 1 illustrates a security system 100 which has a system control panel 102 for monitoring and/or controlling devices installed on a network 110. The devices may detect and/or control door openings and closings, detect alarm conditions, notify people within an area about alarm conditions, track and/or control temperature, or accomplish other functions which may be desired. For example, the system 100 may be used within a light industrial building or a residence.

The system 100 has one or more infrared (IR) sensors, such as first IR sensor 104, second IR sensor 106 and N IR sensor 108 connected to the network 110 and in communication with the system control panel 102. The first, second, through N IR sensors 104-108 may be configured to control and/or monitor a first door 112, second door 114, through N door 116, respectively. The first through N IR sensors 104-108 may receive power from, and communicate with, the system control panel 102 over the network 110. Each of the first through N IR sensors 104-108 may have a unique address on the network 110.

Alarm condition detectors 118, 120 and 122 may be connected on the network 110 and are monitored by the system control panel 102. The detectors 118-122 may detect fire, smoke, temperature, chemical compositions, or other hazardous conditions. When an alarm condition is sensed, the system control panel 102 transmits an alarm signal to one or more notification device 124, 126 and/or 128 through the network 110. The notification devices 124, 126 and 128 may be horns and/or strobes, for example, and may be addressable or non-addressable notification devices as discussed further below.

The system control panel 102 is connected to a power supply 130 which provides one or more levels of power to the system 100. One or more batteries 132 may provide a back-up power source for a predetermined period of time in the event of a failure of the power supply 130 or other incoming power. Other functions of the system control panel 102 may include indicating the status of the system 100, resetting a component, a portion, or all of the system 100, silencing signals, turning off strobe lights, and the like.

The network 110 is configured to carry power and communications to the addressable notification devices from the system control panel 102. Each addressable notification device 124-128 has a unique address and may be capable of bidirectional communication with the system control panel 102. The addressable notification devices 124-128 may communicate their status and functional capability to the system control panel 102 over the network 110. In contrast, a notification signal sent on the network 110 from the system control panel 102 may be received and processed by each non-addressable notification device.

The system control panel 102 has a control module 134 which provides control software and hardware to operate the system 100. Operating code 136 may be provided on a hard disk, ROM, flash memory, stored and run on a CPU card, or other memory. An input/output (I/O) port 138 provides a communications interface at the system control panel 102 with external communication devices 160 such as a laptop computer, personal digital assistant and the like.

A central monitoring station 146 may receive communications from the system control panel 102 regarding security alerts and alarm conditions. The central monitoring station 146 is typically located remote from the system 100 and provides monitoring functions to more than one security system.

Figure 2:
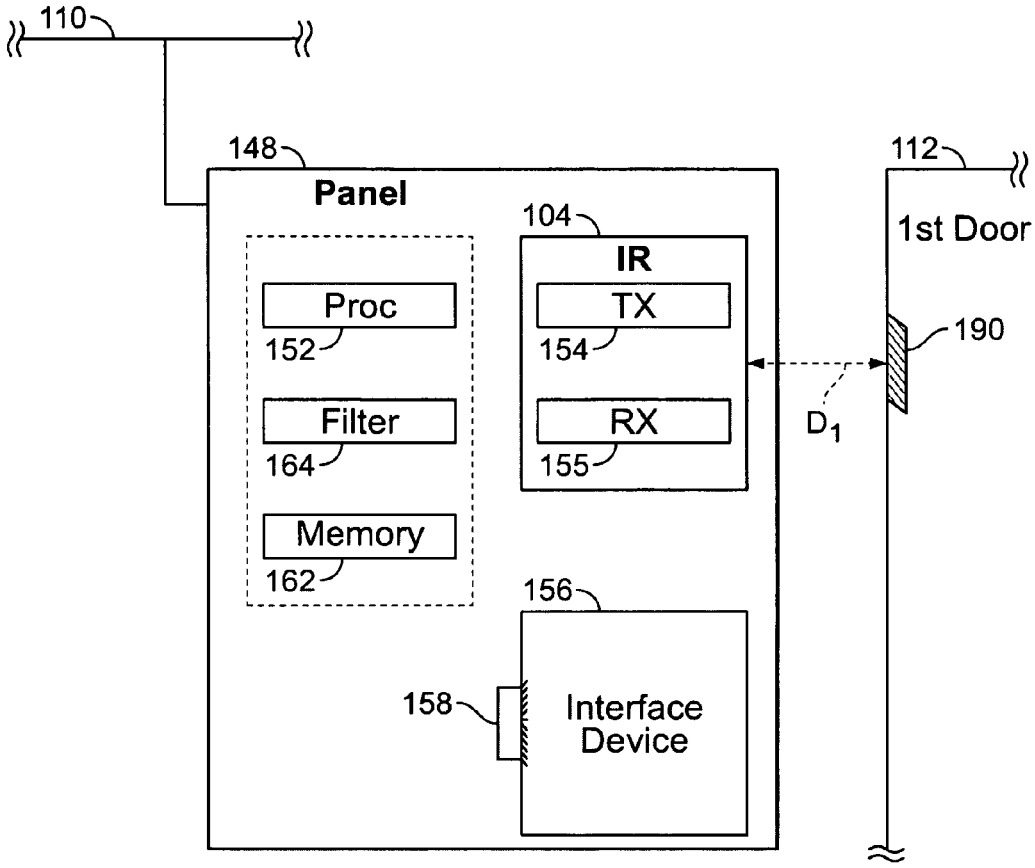
FIG. 2 illustrates the first infrared (IR) sensor of FIG. 1 which may be used to detect the position of the first door in accordance with an embodiment of the present invention.

FIG. 2 illustrates the first IR sensor 104 which may be used as a reflectivity sensor to detect the position of the first door 112. The first IR sensor 104 may be installed in one of several positions relative to the first door 112 wherein infrared signals may be reflected and received from a reflecting surface associated with the first door 112. As illustrated, the first IR sensor 104 may be installed in a panel 148 located on a wall or other surface proximate to the first door 112. The first IR sensor 104 has an IR transmitter 154 and an IR receiver 155. The first IR sensor 104 may have a field of view of approximately 60 degrees which includes a surface of the first door 112, such as a front or back face or surface, and/or a reflector 190 (if present) mounted on and/or optionally protruding from a surface of the first door 112. The first IR sensor 104 is positioned at a distance D1 from the desired reflecting surface of the first door 112. The distance D1 is at least in part dependent upon the signal strength of the first IR sensor 104.

Figure 3:
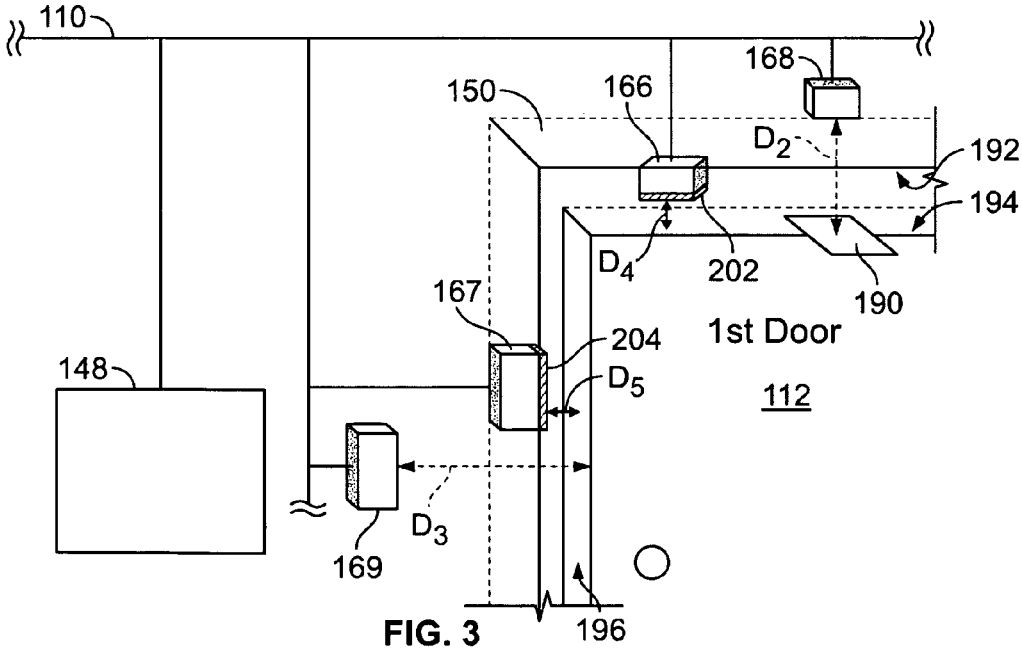
FIG. 3 illustrates alternative positions for mounting or positioning the first IR sensor with respect to the first door in accordance with an embodiment of the present invention.

FIG. 3 illustrates alternative positions for mounting or positioning the first IR sensor 104 with respect to the first door 112. The IR sensors which are installed in the multiple positions may have the same configuration, functionality and field of view as discussed relative to the first IR sensor 104 (FIG. 2), and thus item numbers are used to reference installation position with respect to the first door 112. In this configuration, the illustrated IR sensors are not installed within the panel 148, and it should be understood that the panel 148 is optional.

The first IR sensor 104 may be installed on a wall proximate to the first door 112, such as at one of wall positions 168 and 169, to the top or side, respectively, of the first door 112, and at distances of D2 and D3, respectively, from a reflecting surface associated with the first door 112. The reflecting surface may be a front, back, or edge surface side of the first door 112 or the reflector 190 may be mounted on the first door 112.

The first IR sensor 104 may also be installed within or mounted on door frame 150, such as at one of door frame positions 166 and 167 which are positioned at distances D4 and D5, respectively, from the reflecting surface, such as a top edge 194 or side edge 196, respectively. The first IR sensor 104 may be installed to be flush, recessed, or slightly protruding with respect to an inner surface 192 of the door frame 150. The positioning of the first IR sensor 104 may depend on one or more factors such as available clearance between the inner surface 192 of the door frame 150 and the top or side edge 194 or 196 of the first door 112. For example, it may be desirable to recess the first IR sensor 104 into the door frame 150 to at least partially obscure the first IR sensor 104 from view.

When the first IR sensor 104 is installed at one of the door frame positions 166 and 167, the distance D4 and D5 to the reflecting surface may be less than the distances D1, D2 and D3 when the first IR sensor 104 is installed in the panel 148 or on the wall. Therefore, a lens 202 and 204 may optionally be used when installing the first IR sensor 104 within the door frame 150 to optimize reflections of the IR signal off of a near-field object.

Figure 4:
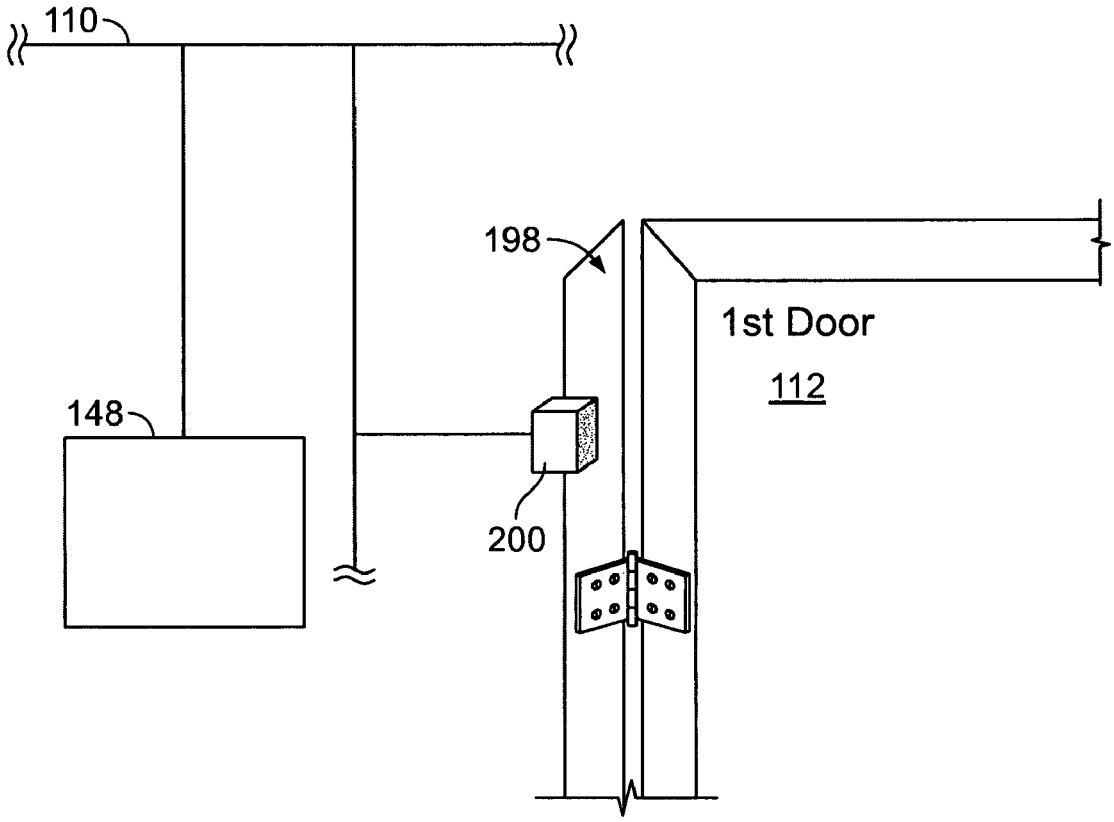
FIG. 4 illustrates an optional mounting position wherein the first IR sensor may be installed on a hinge side of the door frame in accordance with an embodiment of the present invention.

FIG. 4 illustrates an optional door frame position 200 wherein the first IR sensor 104 may be installed on a hinge side 198 of the door frame. Referring also to FIG. 3, the vertical and horizontal positions of the door frame positions 166, 167 and 200 are not restrictive. Also, when the first IR sensor 104 is installed in one of the door frame positions 166, 167 or 200, or one of the wall positions 168 or 169, the first IR sensor 104 may communicate directly with the system control panel 102 over the network 110 and/or be in communication with the panel 148.

Returning to FIG. 2, the panel 148 is connected to the network 110 and may have a processor 152 and memory 162, as well as a filter 164 for filtering background noise as discussed below. Alternatively, the processor 152, memory 162 and filter 164 may be housed together with the first IR sensor 104 on a single chip or small circuit board for installation without the panel 148. The processor 152 may control the IR transmitter 154 within the first IR sensor 104 to quickly flash, such as to flash every 50 ms or every second. Flashing reduces current consumption compared to IR sensors which continually transmit infrared signals.

An interface device 156 with an optional backlight 158 may be installed on the panel 148. The interface device 156 may provide one or more of a keypad, fingerprint reader, card reader, Radio Frequency Identification (RFID) reader, alpha/numeric (A/N) display, speaker, or other device. For example, if a keypad is available, a user may enter access codes and/or manually change settings at the panel 148. If installed in the panel 148, the first IR sensor 104 may be used to detect the presence of an object, such as a hand, in close proximity to the panel 148, and in response may turn on the backlight 158, activate one or more of the available interface devices, or activate interface circuitry, such as enable the RFID reader.

By quickly flashing the first IR sensor 104, data packets may be transmitted which may be used to detect proximity of an object (the first door 112) as well as detect the presence of a foreign reflective object. The processor 152 may define a duty cycle having an active period and an idle period for the IR transmitter 154. The IR transmitter 154 transmits a control data packet during the active period. The IR receiver 155, however, is always active and is always receiving IR data and/or reflected data packets. IR data may be infrared background noise, while the reflected data packet is the control data packet which has been reflected off an object.

The first IR sensor 104 is calibrated to store IR reflectivity data in the memory 162 that is associated with the desired reflective surface, such as the reflective surface of the first door 112 or the reflector 190 at one or more desired positions. Each surface which reflects IR has a different level of reflectivity and creates a different reflectivity signature. The IR reflectivity data may comprise one or both of diffuse or specular reflectance which may change based on the angle of incidence and distance.

For detecting the proximity of the first door 112 with the first IR sensor 104, the first IR sensor 104 is positioned so that the control data packet may be reflected off the first door 112 (or the reflector 190) as a reflected data packet when the first door 112 is closed. The reflected data packet will have a known door reflectivity which was determined during calibration. Therefore, if an object such as a thin piece of wood or metal were inserted between the first IR sensor 104 and the first door 112, the reflectivity of the reflected data packet would be different and a trouble indication may be generated.

When the first door 112 is open, however, the control data packet may not be reflected and thus the IR receiver 155 does not receive a reflected data packet. In another embodiment, the first IR sensor 104 may be configured to receive a reflected data packet which may be reflected off another object, such as a hand or an identification item, such as a badge, which has a different reflectivity than the door reflectivity. In this configuration, a trouble signal may not be generated.

The filter 164 samples IR data acquired by the IR receiver during the idle period of the duty cycle when the IR transmitter 154 is not transmitting to determine a level of background noise. When the IR receiver 155 detects a reflected data packet, the filter 164 filters the reflected data packet to remove background noise based on a previously determined level of background noise. Using the filter 164 may remove extraneous noise, such as increased sunlight or attempted tampering by shining a light at the IR receiver 155.

Figure 5:
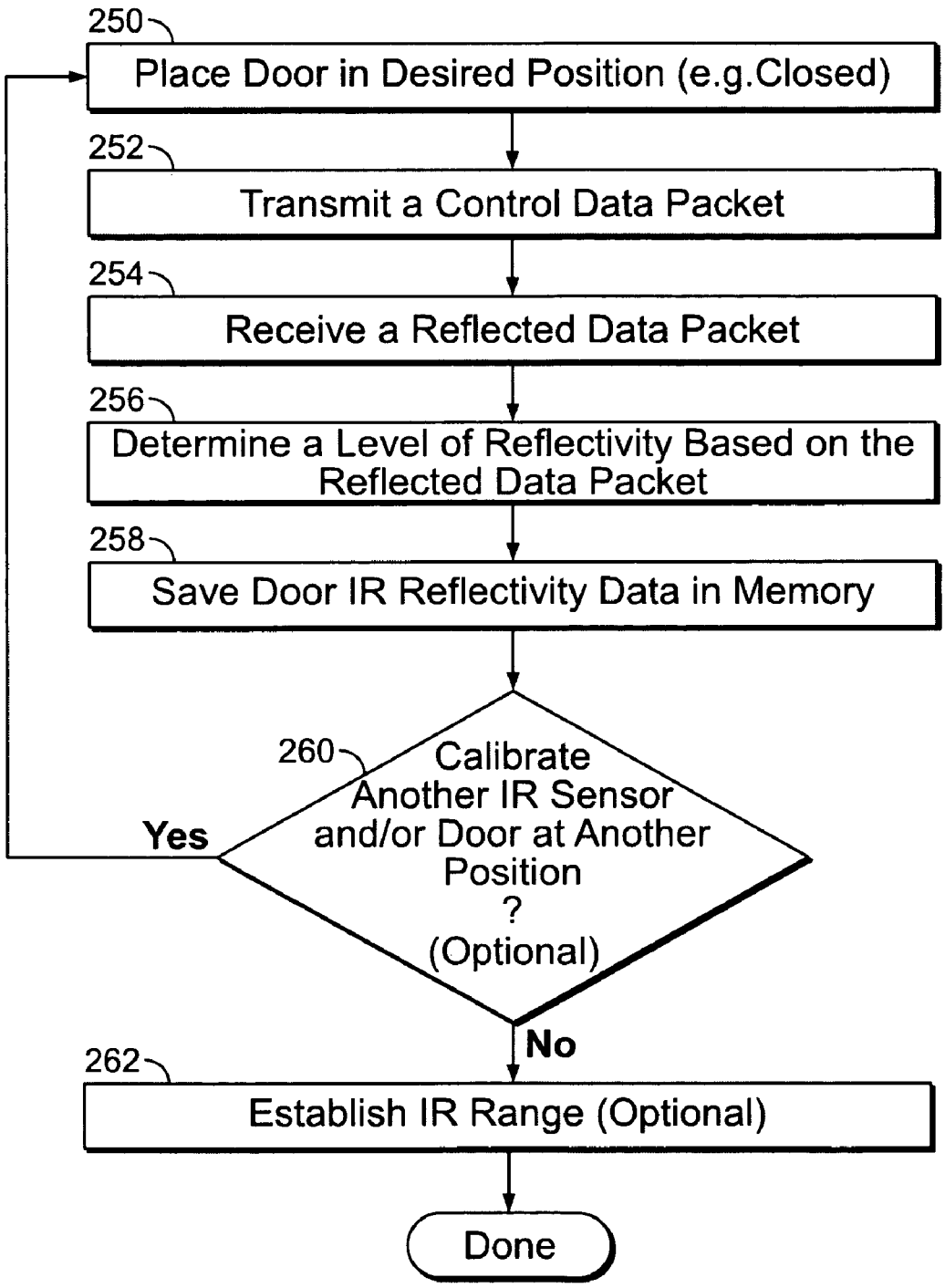
FIG. 5 illustrates a method for calibrating the first IR sensor for use as a reflectivity sensor within the security system in accordance with an embodiment of the present invention.

FIG. 5 illustrates a method for calibrating the first IR sensor 104 for use as a reflectivity sensor within the security system 100. Each of the IR sensors installed may be used to detect reflected data packets from an associated door and/or to detect proximity of other objects. For each of the IR sensors to be used as a door position sensor, door IR reflectivity data or reflectivity signatures are acquired when the door is in one or more predetermined positions. This method may also be performed for the IR sensors installed in other positions as previously discussed.

Figure 6:
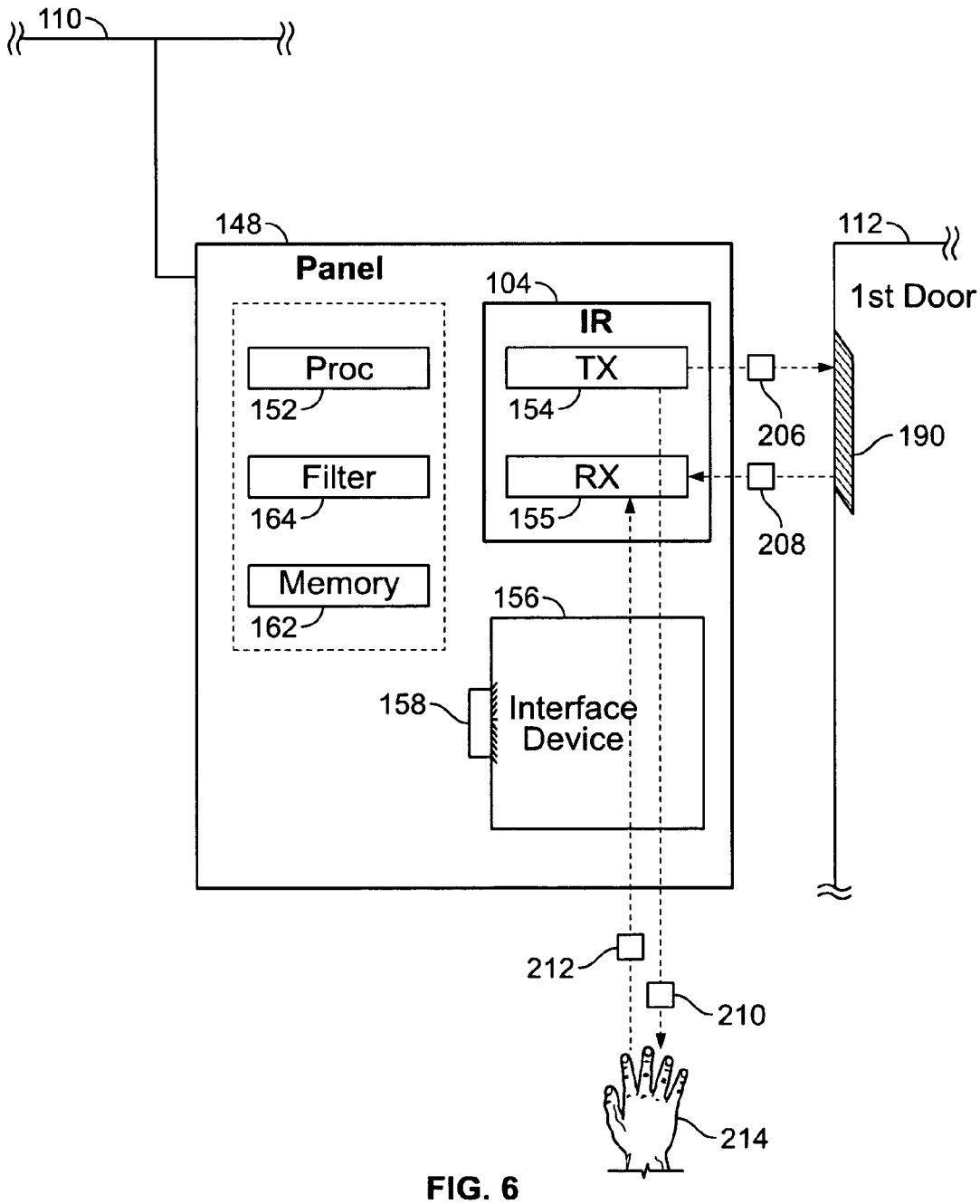
FIG. 6 illustrates the configuration of FIG. 2 wherein the first IR sensor is used to detect both the position of the first door and the proximity of other objects in accordance with an embodiment of the present invention.

FIG. 6 illustrates the configuration of FIG. 2 wherein the first IR sensor 104 is used to detect both the position of the first door 112 and the proximity of other objects. In this example, the range of transmission of the first IR sensor 104, which may be 60 degrees, includes the reflector 190 mounted on the first door 112 as well as area proximate to the interface device 156 of the panel 148. The IR transmitter 154 may transmit a plurality of control data packets 206 and 210. The contents of the control data packets 206 and 210 may be the same and may be defined by an industry standard protocol as previously discussed; however, different item numbers are used for clarity. FIGS. 5 and 6 will be discussed together.

At 250, the first door 112 is placed in a desired position, such as closed. At 252, the IR transmitter 154 transmits a control data packet 206 which is reflected by the reflector 190 as reflected data packet 208. At 254, the IR receiver 155 receives the reflected data packet 208 which has an associated packet IR reflectivity. At 256, the processor 152 determines a level of door IR reflectivity based on the packet IR reflectivity of the reflected data packet 208. At 258, IR reflectivity data, which may also be referred to as the door IR reflectivity and is associated with control data packets reflected by the reflector 190 when the first door 112 is closed, is stored in the memory 162.

At 260, the processor 152 optionally determines whether another IR sensor associated with the first door 112 is to be calibrated or if IR reflectivity data is to acquired with the first door 112 in a different door position. If Yes, the method returns to 250. For example, more than one IR sensor may be used to monitor a single door for additional security. Also, if may be desirable to establish an IR range of IR reflectivity which may further ensure that the first door 112 is completely closed and/or latched and/or secured. It may be possible to position the first door 112 in a position which is not secured or latched that still reflects the control data packet 206. Therefore, additional IR reflectivity data may be acquired by placing the first door 112 in the unacceptable position. In 262, the processor 152 may then determine an IR range which indicates that the first door 112 is closed, latched and/or secured. (Optionally, no IR range may be determined.) IR reflectivity data outside the IR range, such as that detected when the first door 112 is in the unacceptable position, would indicate a door open position even if the first door 112 is not visibly open.

Figure 7:
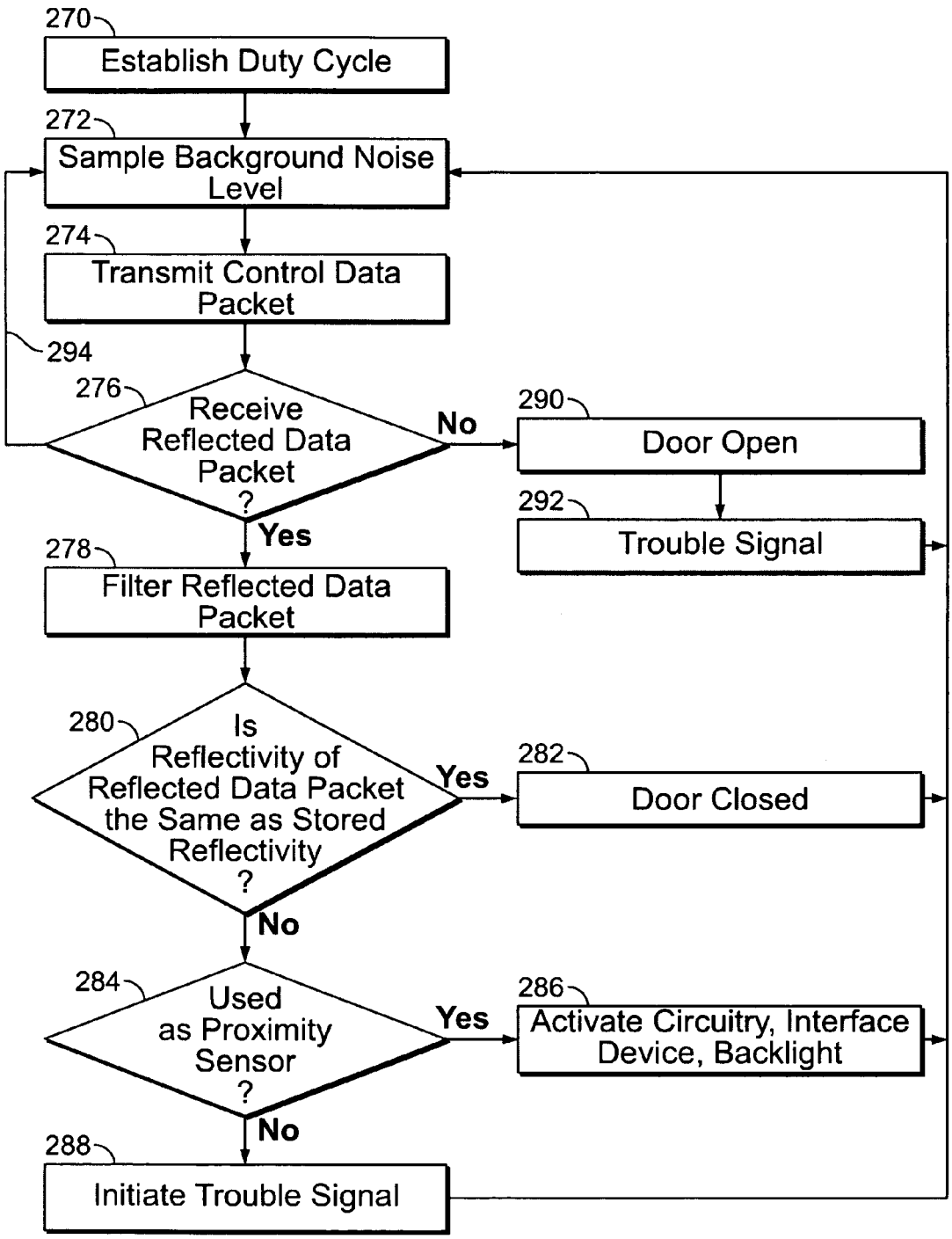
FIG. 7 illustrates a method for using the first IR sensor as a proximity sensor within the security system of FIG. 1 in accordance with an embodiment of the present invention.

FIG. 7 illustrates a method for using the first IR sensor 104 as a proximity sensor within the security system 100. At 270, the processor 152 establishes the duty cycle defining how often the IR transmitter 154 will transmit the control data packets. In other words, the time durations of the active period and idle period are determined. At 272, the processor 152 samples a level of background noise during the idle period of the IR transmitter 154. The processor 152 may sample the level of background noise one or more times during a single idle period, and the sampling may be repeated during each idle period as the level of light may change over time due to sunlight, electric lights being turned on and off, and the like. Sampling the background noise also eliminates the problem experienced by IR sensors which continually transmit IR and may be defeated by shining a light at the IR receiver 155.

At 274, the IR transmitter 154 transmits the control data packet. The control data packet may be a beacon or broadcast signal, or any other type of data packet. In this configuration, the IR reflectivity of the reflected data packet is of interest but the content of the control data packet may or may not be verified.

At 276, the IR receiver 155 may detect a reflected data packet which has an associated packet IR reflectivity. If the first door 112 is closed, the IR receiver 155 will receive a reflected data packet virtually simultaneously as the IR transmitter 154 transmits the control data packet. If the first door 112 is open, however, the control data packet is not reflected by the first door 112 or the reflector 190, if present. If the first IR sensor 104 is configured to detect proximity of an object, such as a hand, the IR receiver 155 will detect the reflected data packet when the object is present and within a predefined distance from the first IR sensor 104, such as within three inches. Line 294 indicates that 272-276 are continually performed as discussed above to maintain an accurate level of background noise and to detect a current position of the first door 112 and/or proximity of an object, if so configured.

At 276, if the IR receiver 155 receives a reflected data packet, the method passes to 278, where the filter 164 filters the reflected data packet based on the most recent level of background noise (272). At 280, the processor 152 compares the reflectivity of the reflected data packet to the door IR reflectivity data (258 of FIG. 5) to determine if the reflected data packet was reflected off the calibration surface, such as the reflecting surface of the first door 112 or the reflector 190.

If the packet IR reflectivity of the reflected data packet 208 (FIG. 6) is the same as the saved door IR reflectivity data, the method passes to 282 where the processor 152 determines that the first door 112 is closed and may initiate a door closed signal which is logged by the memory 162 and/or transmitted to the system control panel 102. Optionally, the processor 152 may compare the IR reflectivity of the reflected data packet to an IR range (if determined in 262 of FIG. 5). The method then returns to 272. If the IR reflectivity of the reflected data packet 208 is different than the saved door IR reflectivity data, the method passes to 284 where the processor 152 determines whether the first IR sensor 104 is also configured to be used as a proximity sensor to detect other objects. If yes, flow passes to 286 where the processor 152 may determine that an object has been held in close proximity to the first IR sensor 104 and has reflected the control data packet 206. For example, in FIG. 6, the IR transmitter 154 may transmit control data packet 210 and the IR receiver 155 receives reflected data packet 212 which has been reflected off hand 214. The processor 152 may then initiate an action such as activating a backlight, activating RFID circuitry, opening the first door 112, and the like. The method then returns to 272. While receiving input from one or more of the interface devices 156, 272-276 may continue to be performed.

Returning to 284, if the first IR sensor 104 is being used as a door sensor but not as a proximity sensor to detect other objects, the method flows to 288. The processor 152 may determine that a foreign object has been held inserted between the first IR sensor 104 and the reflector 190, and may initiate a trouble signal to indicate a suspected tampering with the security system 100 and/or the first IR sensor 104. The trouble signal may be sent to the system control panel 102 over the network 110, forwarded to the central monitoring station 146, and/or may initiate activation of one or more of the notification devices 124-128. The method then returns to 272.

Returning to 276, if a reflected data packet is not received, the method flows to 290 where the processor 152 determines that the first door 112 is open. In 292, the processor 152 may initiate at least one of a door open signal and a trouble signal that is sent to the system control panel 102 over the network 110. The system control panel 102 may optionally log the trouble signal, send the trouble signal to the central monitoring station 146, and/or activate one or more of the notification devices 124-128. Alternatively, the processor 152 may log the door openings and closings in memory 162, and may initiate the trouble signal if the first door 112 remains open longer than a predetermined amount of time. Alternatively, the processor 152 may initiate a trouble signal during periods of time when it has been determined that the first door 112 should not be open, such as outside of predefined business hours.

While the invention has been described in terms of various specific embodiments, those skilled in the art will recognize that the invention can be practiced with modification within the spirit and scope of the claims.

What is claimed is:

1. A security system, comprising:

an infrared (IR) sensor configured to be mounted proximate to a reflecting surface of a door to be monitored, the IR sensor having an IR transmitter and an IR receiver, the IR transmitter having an active period and an idle period, the IR transmitter transmitting an intermittent control signal including control data packets during the active period, the intermittent control signal reducing a power consumption of the IR sensor, the IR receiver having an active period for detecting reflected data packets;

a processor providing the control data packets to be transmitted by the IR transmitter, the processor determining a level of packet IR reflectivity for each of the reflected data packets;

a backlight configured to light an interface device that is configured to receive input from a user, the backlight and the interface device mounted proximate to the door; and a memory storing a level of door IR reflectivity associated with the reflecting surface of the door when the door is closed, the processor comparing the level of packet IR reflectivity to the level of door IR reflectivity to determine that the door is closed when the level of packet IR reflectivity determined by the processor and the level of door IR reflectivity stored in the memory are substantially the same, the processor activating the backlight when the IR sensor senses an object within a predetermined distance of the interface device.

2. The system of claim 1, further comprising a filter for filtering reflected data packets, the IR receiver further receiving IR data representative of background noise during the idle period of the IR transmitter, the filter filtering the reflected data packets based on the IR data received during the idle period.

3. The system of claim 1, the IR transmitter transmitting a first control data packet, the processor identifying a door open position associated with the door when a first reflected data packet corresponding to the first control data packet is not received by the IR receiver.

4. The system of claim 1, the processor further identifying a door closed position associated with the door when the level of door IR reflectivity and the level of packet IR reflectivity are within a predetermined IR range.

5. The system of claim 1, the processor initiating a trouble indication when the level of door IR reflectivity and the level of packet IR reflectivity are different with respect to each other.

6. The system of claim 1, further comprising a network interconnecting the IR sensor, the processor and the memory with a system control panel, the processor transmitting a trouble indication over the network to the system control panel when the level of door IR reflectivity and the level of packet IR reflectivity are different with respect to each other.

7. The system of claim 1, wherein the interface device comprises at least one of a keypad, fingerprint reader, card reader, radio frequency identification reader, alpha/numeric display and a speaker.

8. The system of claim 1, further comprising a control panel located proximate to the door, the control panel comprising the backlight and the interface device, wherein the IR sensor is one of mounted within a door frame proximate to the door, mounted on a wall proximate to the door, and mounted on the control panel.

9. The system of claim 1, further comprising an IR reflector mounted on the door, the IR transmitter being positioned to reflect the control data packet off the IR reflector when the door is in a predetermined position, the level of door IR reflectivity further comprising IR reflectivity based on the IR reflector.

10. A method for using an IR sensor within a security system, comprising:

transmitting an intermittent control signal, including a control data packet, with an infrared (IR) transmitter of an IR sensor to detect a surface associated with a door, the intermittent signal reducing a power consumption of the IR sensor;

receiving a reflected data packet with an IR receiver of the IR sensor, the reflected data packet having a packet IR reflectivity;

comparing the packet IR reflectivity to a door IR reflectivity, the door IR reflectivity being based on the surface associated with the door;

initiating a trouble indication when a door open position is detected for greater than a predetermined amount of time, the door open position being determined based on the comparison of the packet IR reflectivity and the door IR reflectivity.

11. The method of claim 10, further comprising:

receiving IR data with the IR receiver to determine a level of background noise; and filtering the reflected data packet based on the IR data.

12. The method of claim 10, further comprising opening the door when the packet IR reflectivity and the door IR reflectivity are different with respect to each other.

13. The method of claim 10, further comprising:

identifying at least one time period during which the door should not be open;

identifying at least one time period during which the door is allowed to be open; and initiating a trouble indication when the door open position is detected during the at least one time period during which the door should not be open.

14. The method of claim 10, further comprising:

positioning the door in a closed position;

transmitting an initial control data packet with the IR transmitter; and receiving a reflected initial control packet with the IR receiver, the door IR reflectivity being based on the reflected initial control packet.

15. The method of claim 10, further comprising filtering the reflected data packet to remove background IR data prior to determining the status of the door.

16. A security system, comprising:

a system control panel;

an infrared (IR) sensor mounted proximate to a door to be monitored and having an IR transmitter and an IR receiver, the IR sensor located remote from the system control panel and connected to the system control panel by a network, the IR transmitter having an active period and an idle period, the IR transmitter transmitting an intermittent control signal including control data packets during the active period, the intermittent control signal reducing a power consumption of the IR sensor, the IR receiver detecting reflected data packets and IR data, the reflected data packets reflecting off a surface and having a packet IR reflectivity;

a processor providing the control data packets to be transmitted by the IR transmitter, and determining the IR reflectivity of an initial reflected data packet to determine a level of door reflectivity associated with the reflecting surface of the door to calibrate the system when the door is closed; and means for transmitting a status signal from the IR sensor to the system control panel based on the determined IR reflectivity.

17. The security system of claim 16, wherein the processor initiates a trouble signal when the packet IR reflectivity and the door IR reflectivity are different with respect to each other, the trouble signal being transmitted as the status signal to the system control panel.

18. The security system of claim 16, wherein the door surface further comprises one of an edge of the door, a front face of the door, a back face of the door and a reflector mounted to the door.

19. The security system of claim 16, further comprising means for filtering the reflected data packet to remove background IR data.

20. The system of claim 1 wherein the processor activates the backlight when the IR sensor senses a person within a predetermined distance of the interface device.

21. The system of claim 1 wherein the processor determines the IR reflectivity of an initial reflected data packet to determine a level of door reflectivity associated with the reflecting surface of the door to calibrate the system when the door is closed.

22. The method of claim 10 further comprising determining the IR reflectivity of an initial reflected data packet to determine a level of door reflectivity associated with the reflecting surface of the door to calibrate the system when the door is closed.

23. The system of claim 10 wherein the IR transmitter transmits an intermittent control signal, including a control data packet, to detect a surface associated with the door, the intermittent signal reducing a power consumption of the IR sensor.

* * * * *